United States Patent [19]

Uitz

[11] 3,987,924

[45] Oct. 26, 1976

[54] PLASTIC CONTAINER

[76] Inventor: Mark O. Uitz, 1050 Crestview Drive, Mountain View, Calif. 94040

[22] Filed: July 25, 1975

[21] Appl. No.: 599,137

[52] U.S. Cl. ..... 220/4 F; 220/76

[51] Int. Cl.[2] ..... B65D 7/00; B65D 7/30

[58] Field of Search ..... 220/4 R, 4 F, 75, 76; 206/503, 509; 217/12 R, 43 R, 65

[56] References Cited

UNITED STATES PATENTS

| | | | |
|---|---|---|---|
| 2,467,698 | 4/1949 | Reynolds | 220/21 |
| 2,483,269 | 9/1949 | Fender | 220/4 R |
| 2,501,980 | 3/1950 | Wolfe | 220/4 F |
| 2,802,590 | 8/1957 | Tupper | 220/352 X |

*Primary Examiner*—William Price
*Assistant Examiner*—Steven M. Pollard
*Attorney, Agent, or Firm*—Lowhurst & Aine

[57] ABSTRACT

A plastic container includes a pair of molded plastic end wall structures affixed to opposite end edges of an intervening wall structure having generally parallel tubular reinforcing rib portions formed as by extrusion. A plurality of prongs project outwardly of the end wall structures in registration with the open ends of the tubular reinforcing ribs for affixing the end wall structures to the intervening wall structure. In one embodiment, thermally insulative plastic foam is affixed to the end, side walls and lid of the box to provide a thermally insulated container. A lug box, a lettuce box, an insulated flower box, and a strawberry box are specifically shown.

18 Claims, 13 Drawing Figures

PLASTIC CONTAINER

BACKGROUND OF THE INVENTION

The present invention relates in general to an improved plastic container and, more particularly, to less expensive or reusable plastic shipping containers or boxes particularly useful agricultural produce.

DESCRIPTION OF THE PRIOR ART

Heretofore, shipping containers for agricultural produce, such as fruit, vegetables, and flowers have been fabricated of glued corrugated paper. The problem with the use of corrugated paper containers it that they are not impervious to moisture and thus deteriorate in use. Moreover, the corrugated paper containers are not reusable and in many cases do not include sufficient ventilation for the produce requiring same.

It is also known from the prior art to provide an injection molded plastic agricultural produce box. However, such injection molded boxes are relatively expensive due to the relatively long cycle time required for the injection molding machinery used to mold such a relatively large item.

It is also known from the prior art to fabricate agricultural produce boxes of molded expanded polystyrene foam. The box is fabricated by injection molding it into a flat or knocked down form to facilitate shipment of relatively large numbers of boxes to the user, i.e. to the packer. The container is assembled by folding the side walls into position along flexible hinge portions and inserting ears projecting from the edges of the box into complementary slots formed in the end walls. Adhesive tape, adhesive alone or other suitable means are used to hold the adjoining side walls together. Such a shipping container is disclosed in U.S. Pat. No. 3,675,808.

While the aforecited foldable foam plastic shipping container has advantages over the prior corrugated paper box, it has the disadvantage of being relatively expensive due to the relatively long cycle time of the injection molding machinery on which the box is fabricated.

SUMMARY OF THE PRESENT INVENTION

The principal object of the present invention is the provision of an improved plastic container particularly useful for shipping agricultural produce.

In one feature of the present invention, a pair of end walls are affixed to an intermediate wall structure having a plurality of elongated tubular reinforcing ribs extending between the end walls and being connected to the end walls via a plurality of prongs projecting from the end wall structures into the open ends of the tubular ribs, whereby a relatively strong inexpensive and light-weight plastic container is obtained.

In another feature of the present invention, the end wall structures of the container are formed by injection molding and preferably formed of a structural plastic foam material, such as polypropolene.

In another feature of the present invention, the end wall structures include a plurality of prongs projecting therefrom, said prongs projecting from the bottom of a channel formed in the end wall structure. The channel is dimensioned to receive the end lip portions of the intermediate wall structure for providing additional end support for the intermediate wall structure.

In another feature of the present invention, a plurality of resilient clips as of plastic, are provided for clipping the end wall structures to the intermediate wall structure of the container, whereby the shipping container may readily be knocked down for return shipment for reuse by removing the clips.

In another feature of the present invention, the intermediate wall structure of the box is formed by a plastic extrusion process, whereby the manufacturing cost of the box is substantially reduced.

In another feature of the present invention, the box includes a plastic lid having a resilient lip portion for clipping the lid to the side edge portions of the intermediate wall structure of the box whereby the lid is easily removed by overcoming the spring force of the clip.

In another feature of the present invention, a plastic foam thermal insulation material is affixed to the wall structures of the box for thermally insulating the container.

In another feature of the present invention, the intermediate wall structure of the box includes a plurality of perforations to receive and hold produce baskets such as those commonly utilized for berries, cherries, cherry tomatoes, and the like.

In another feature of the present invention, the end wall structures for the plastic container comprise a plastic frame member having a generally planar insert disposed within the frame to receive labels or other indicia of origin.

Other features and advantages of the present invention will become apparent upon a perusal of the following specification taken in connection with the accompanying drawings wherein:

BRIEF DESCRIPTION OF THE DRAWINGS

FIG. 11 A is an enlarged foreshortened sectional view of the structure of FIG. 11 taken along line 11A in the direction of the arrows.

DESCRIPTION OF THE PREFERRED EMBODIMENTS

Figure 1:
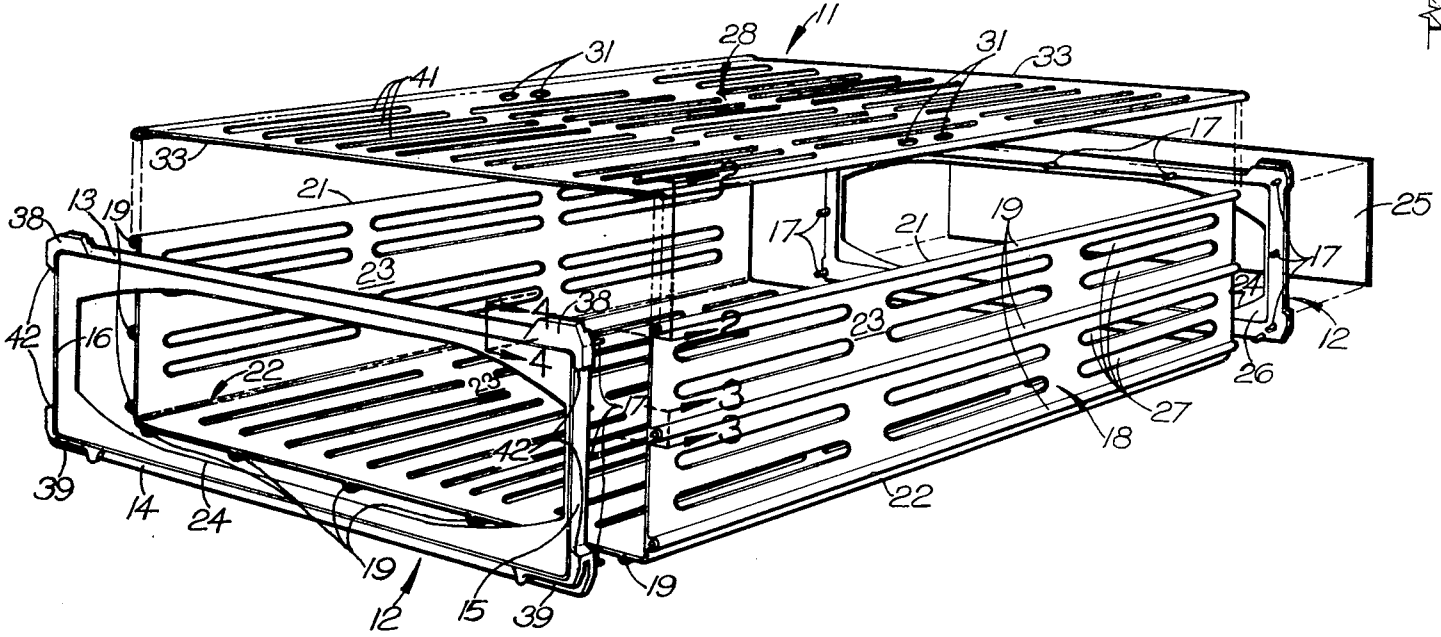
FIG. 1 is an exploded perspective view of a plastic container incorporating features of the present invention.

Referring now to FIG. 1, there is shown a plastic container 11 for agricultural produce such as fruits or vegetables. The container 11 includes a pair of end wall structures 12, preferably made by injection molding of a structural foam material such as polypropolene foam. The end wall structures 12 are in the general form of a frame having a pair of broad top and bottom parallel side edges 13 and 14, respectively, interconnected by a pair of generally parallel narrow side edges 15 and 16, respectively.

A plurality of prongs 17, as of 0.125 inch diameter and 0.5 inch in length, project outwardly from the frame 12 along the bottom and vertical side edges 14, 15 and 16, respectively. An intermediate wall structure 18 is provided for connection to the end wall structures 12. The intermediate wall structure 18 is made of a plastic material such as high impact styrene or polypropolene, and is preferably formed by extrusion.

The intermediate wall structure 18 includes a plurality of hollow reinforcing ribs 19 (tubular portions) extending longitudinally of the container 11 parallel to the side lip portions 21. In a preferred embodiment, the extruded intermediate wall structure 18 includes a pair of thin hinge portions 22 of a thinner wall construction than the adjacent web portions 23 provided between the reinforcing ribs 19.

In a typical example, the web portion 23 has a thickness as of 0.25 inch to 0.030 inch and the hinge portions 22 have a thickness as of 0.008 inch to 0.010 inch to facilitate bending of the side wall panels into the vertical plane relative to the horizontal central region or bottom panel of the intermediate wall structure 18.

Figure 3:
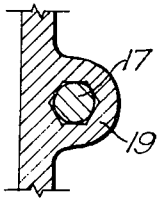
FIG. 3 is an enlarged sectional view of a portion of the structure of FIG. 1 delineated by lines 3—3.

The prongs 17 are disposed in registration with the reinforcing ribs 18 such that upon folding of the side panels into the vertical, the prongs 17 may be force-fitted into the tubular reinforcing ribs 19 for fixedly securing the end wall structures 12 to the intermediate wall structure 18. In a typical example, the hollow interior of the tubular reinforcing ribs 19 is of hexagonal configuration as shown in FIG. 3 and the prongs 17 are of tapered circular cross-section for making a force-fit with the reinforcing ribs 19. As an alternative, the reinforcing ribs 19 may have a circular hole and the prongs 17 may have a hexagonal cross-section.

The end wall structures 12 have central openings 24 for display of cardboard inserts 25 of generally planar rectangular shape having graphics printed thereon for display through the opening 24 to indicate the source of origin of the produce. The insert 25 is secured within a rectangular recess 26, at the inside of the end wall structures 12, as by a suitable adhesive or cement. If desired, the insert 25 may be perforated to facilitate ventilation to the container 11. In addition, the intermediate wall structure 18 includes a multitude of elongated perforations 27 for ventilation of the container 11.

Figure 2:
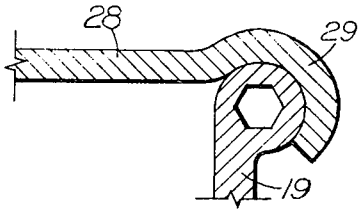
FIG. 2 is an enlarged sectional view of a portion of the structure of FIG. 1 delineated by line 2—2.
Figure 4:
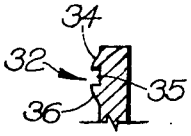
FIG. 4 is an enlarged sectional view of a portion of the structure of FIG. 1 delineated by line 4—4.

A plastic lid structure 28 is provided for closing off the top of the intermediate wall structure 18. The lid 28 includes a resilient channel 29 disposed along the side lips of the lid 28 for releasably gripping (clipping to) the upper side lip 19 of the side wall panels as shown in FIG. 2. Two pairs of finger holes 31 are provided near the side edges of the lid 28, generally midway lengthwise of the lid, to facilitate placement and removal of the lid 28. In addition, a channel type detent 32 is provided extending along the top broad side edge 13 at the inside wall of the end wall structure 12, as shown in FIG. 4, to receive the end lip portions of the lid 28.

The user depresses the lid structure 28 causing the end lip portion 33 of the lid to ride down over a first tapered detent 34 into a channel shaped recess 35 defined between the upper detent 34 and a lower boss 36. When the lip 33 rides over the detent 34, it is captured within the recess 35 against inadvertent removal of the lid 28. When it is desired to remove the lid 28, the operator grasps the lid via the finger holes 31 and pulls up on the lid 28 causing deformation thereof and release of the lid structure from the sides and ends of the container 11.

The end wall structures 12 each include a pair of upwardly directed stacking tabs 38 at opposite ends of the upper edge 13. The stacking tabs 38 mate with stacking recesses 39 provided at opposite ends of the bottom broad side edges 14 to prevent relative sliding movement between vertically stacked containers 11. The lid 28 includes a multitude of elongated perforations 41 to facilitate ventilation of the container. The lid is preferably formed by extrusion.

The vertical narrow side edges 15 and 16 are centrally recessed at 42 to provide side ventilation to the side wall structures 18 when the containers 11 are stacked in side-by-side relation.

In manufacture of the lid 28 and intermediate wall structure 18, the web and tubular reinforcing ribs 19 are preferably integrally formed in the extruded plastic part and the extruded sheet is cut laterally into sections of the proper length. The perforations are punched to provide the ventilation holes 27 and 41, respectively.

The plastic container 11 in the knocked down state comprises a number of relatively flat parts that may be shipped without occupying excessive volume. The containers are readily assembled in the field or at the packing house by folding up the side panel portions of the intermediate wall structure 18 and pushing the end wall structures 12 into place against the end edges of the intermediate wall structure 18. The assembled container 11 is readily knocked down for return and reuse by knocking out the end wall structures 12 and unfolding the intermediate wall structure 18 into a flat shape. Also, the plastic container 11 may be readily reclaimed and recycled by grinding up the plastic parts and reusing the plastic material as charge for the extruder utilized to extrude the intermediate wall structure 18 and the lid 28. Due to the provision of the extruded lid and side wall 18, the manufacturing cost for the plastic container 11 is substantially reduced as compared with prior containers of the paper or plastic molded type.

Figure 5:
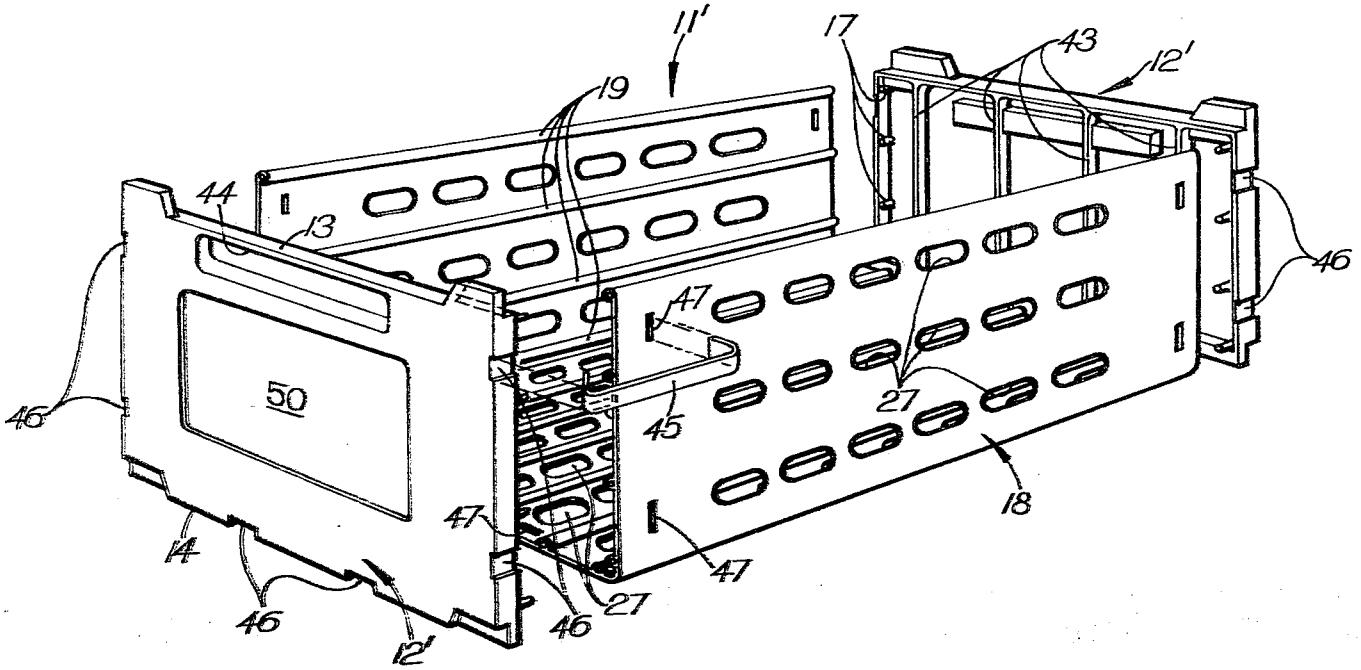
FIG. 5 is an exploded perspective view of a shipping container similar to that of FIG. 1 depicting an alternative embodiment of the present invention.

Referring now to FIG. 5, there is shown an alternative plastic container 11′ essentially the same as that of FIG. 1 with the exception that the intermediate wall structure 18 is folded with the reinforcing ribs 19 toward the inside of the container and the end wall structures 12′ are of solid wall construction as opposed to the frame construction utilized in the box of FIG. 1. The end wall structures 12′ include vertically directed reinforcing ribs 43 and an elongated finger gripping recess 44 near the upper broad side edge 13 thereof.

The end walls 12′ are additionally held to the intermediate wall structure 18 via a plurality of resilient generally U-shaped clips 45 which fit in aligned recesses 46 in the end wall structures 12' and slots 47 in the intermediate wall structure 18. The clips 45 serve to clip the end walls 12' to the intermediate wall structure 18. The clips 45 may be of a strong resilient plastic or steel. A shallow rectangular recess 50 is provided in the outer face of each of the end wall structures 12' to receive a label. The container 11' of FIG. 5 is particularly suitable as a lettuce crate.

Figure 7:
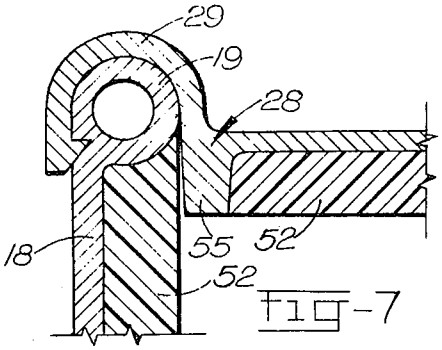
FIG. 7 is an enlarged sectional view of a portion of the structure of FIG. 6 delineated by line 7—7.
Figure 6:
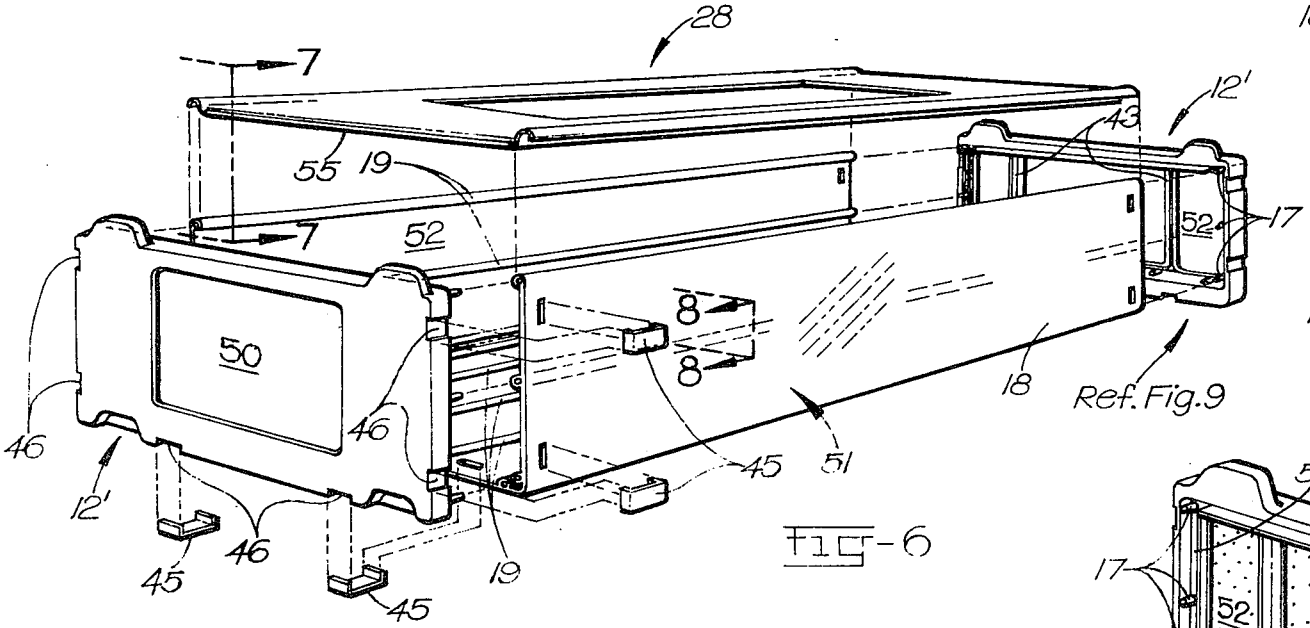
FIG. 6 is an exploded perspective view of a plastic thermally insulated container particularly useful for shipping flowers and incorporating features of the present invention.

Referring now to FIG. 6 there is shown a thermally insulated flower shipping container 51 embodying features of the present invention. More particularly, the container 51 is of substantially the same general configuration as that of FIG. 5 with the exception that the container does not include ventilation perforations 27 and the inside walls of the container are lined with a plastic thermal insulation material, as of polyethylene foam, applied as by spraying or cementing sheets of plastic foam to the inside walls of the container 51. In addition, the lid 28 has foam material lining its interior wall as shown in FIG. 7.

Figure 8:
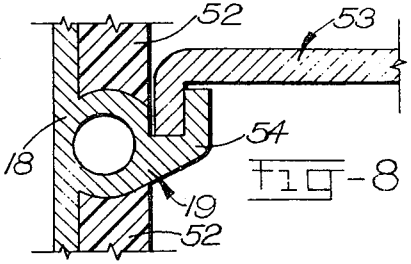
FIG. 8 is an enlarged cross-sectional detail view of a portion of the structure of FIG. 6 delineated by line 8—3.

If desired, a horizontal dividing wall may be provided intermediate the height of the box for partitioning the container into two container portions. The divider wall 53, which may comprise an extrusion with a downturn lip along the side edges, mates with an upturned lip of a hanger portion 54 extending out from one of the ribs 19 of the intermediate wall structure 18 as shown in FIG. 8. The lid 28 also preferably includes a plurality of solid longitudinal reinforcing ribs 55 for added strength.

Figure 9:
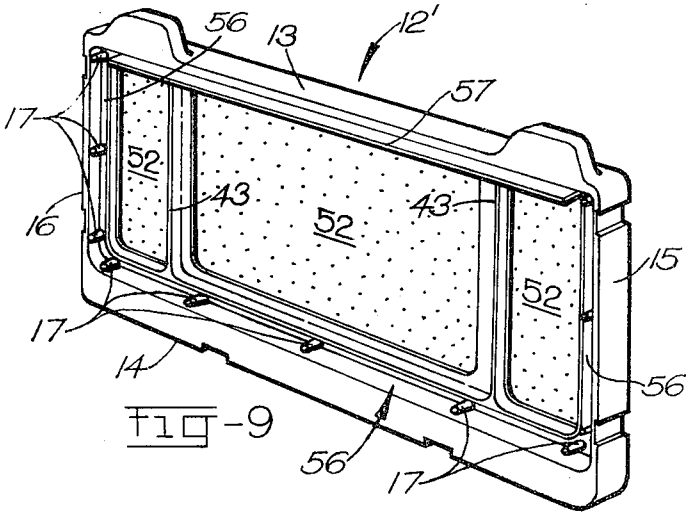
FIG. 9 is an enlarged detail perspective view of a portion of the structure of FIG. 6 delineated by line 9—9.

Referring now to FIG. 9, there is shown the inside face of the end wall structure 12'. The prongs 17 are recessed within a channel 56 which extends along the narrow side edges 15 and 16 and along the bottom side edge 14 of the end wall structure 12'. The width of the channel 56 is dimensioned to be approximately equal to the thickness of the intermediate wall structure 18 to facilitate making a relatively gas-tight connection between the end wall structures 12' and the intermediate wall structure 18 to minimize the transfer of heat to the inside of the container by convection. In addition, an inwardly directed lip 57 is provided along the upper broad edge 13 to support the end portions of the lid 28 and to facilitate making a gas-tight connection to the lid. The recessed channel 56 containing the prongs 17 serves to prevent inadvertent breakage of the prongs during shipment of the containers 51 in the knocked down state. In a typical example, the flower container 51 is 48 inches long, 22 inches wide and 8½ inches deep.

Figure 10:
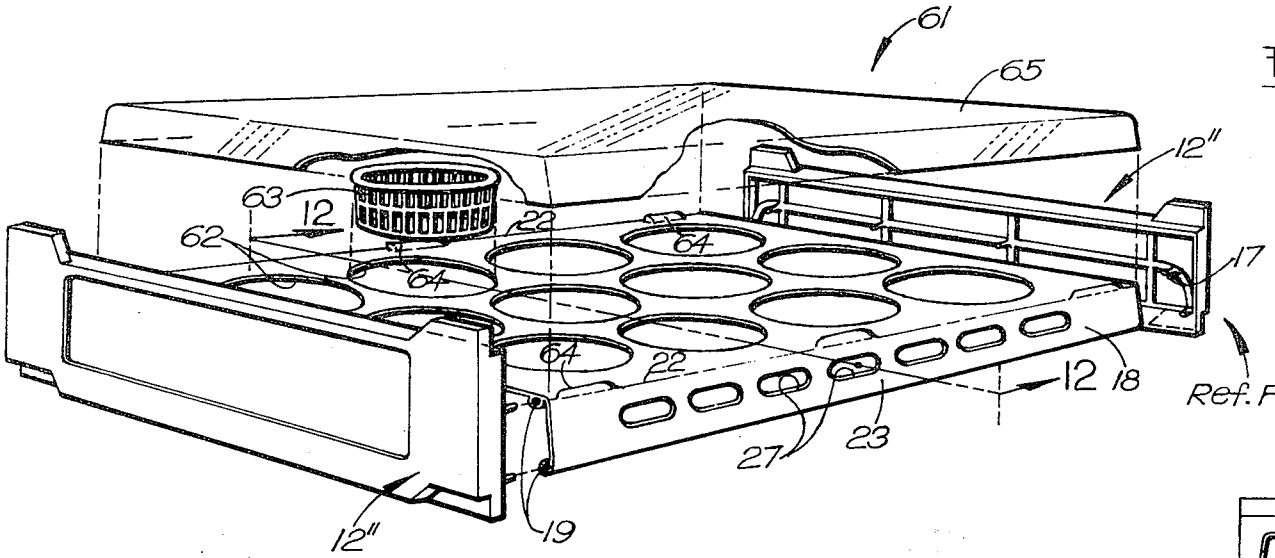
FIG. 10 is an exploded perspective view of a plastic shipping container incorporating features of the present invention.

Referring now to FIG. 10, there is shown a plastic container 61 incorporating features of the present invention and particularly suitable for shipping and displaying berries and other small fruits and vegetables as contained in their individual baskets 63. The intermediate wall structure 18 has the side panels turned downwardly along hinge lines 22 and slightly inclined to the vertical. The prongs 17 are provided intermediate the height of the end walls 12' such that the central panel portion of the intermediate wall structure 18 forms a shelf which is perforated by perforations 62 to receive the fruit baskets 63. The upper shoulder of the fruit basket 63 rests upon the lip of the apertures 62 for supporting the baskets within the container 61. A plurality of upturned tabs 64 are provided along the hinge lines 22 to catch and retain the downturned sidewall portions of a clear transparent cover 65 as of acrylic plastic.

Figure 11:
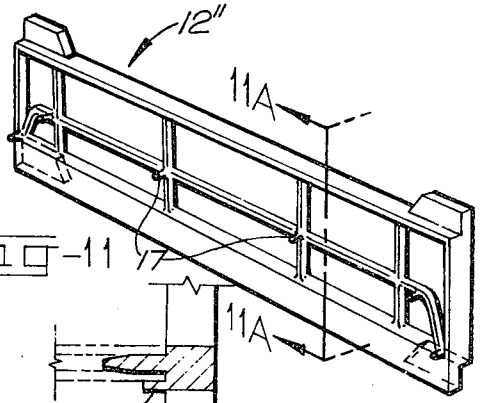
FIG. 11 is an enlarged perspective view of an end wall portion of the structure of FIG. 10.
Figure 11A:
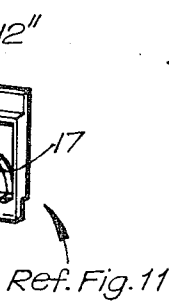
Figure 12:
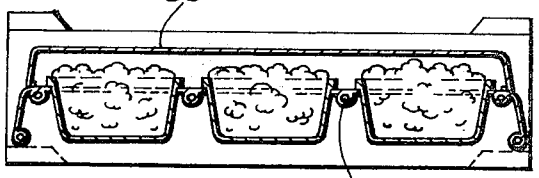
FIG. 12 is a transverse sectional view of the structure of FIG. 10 taken along line 12—12 in the direction of the arrows.

Referring now to FIG. 12, the longitudinal reinforcing ribs 19, in the central panel portion of the intermediate wall structure 18, pass between adjacent longitudinal rows of apertures 62 for supporting the central panel. Additional end support for the central panel portion of the intermediate wall 18 is provided by a lip 66 of end wall 12'' extending along and slightly below the path defined by the prongs 17 which are to support the central panel portion of the intermediate wall structure 18. The lip is shown in FIG. 11.

What is claimed is:

1. In a plastic container:

a pair of plastic end wall structures having a plurality of plastic prong portions projecting therefrom;

an intermediate plastic wall structure having a pair of spaced apart side edge portions and a pair of spaced apart end edge portions, said intermediate wall structure having a plurality of generally parallel tubular reinforcing rib portions disposed in generally parallel relation with said side edge portions, said tubular rib portions being disposed in registration with said prongs of said end wall structures to receive said prongs axially of said tubular rib portions for affixing said end wall structures to said intermediate wall structure.

2. The apparatus of claim 1 wherein each of said end wall structures comprises a molded plastic part.

3. The apparatus of claim 1 wherein each of said end wall structures comprises a molded plastic foam frame structure.

4. The apparatus of claim 1 wherein each of said end wall structures includes a channel portion having said prong portions projecting outwardly from the bottom thereof, said channel having a width dimensioned relative to the thickness of the adjacent end edge portion of said intermediate wall structure to receive said end edge portion therein.

5. The apparatus of claim 1 wherein said intermediate wall structure including said tubular ribs comprises a plastic extrusion.

6. The apparatus of claim 1 wherein said intermediate wall structure is perforated for ventilation.

7. The apparatus of claim 1 including a lid structure having a resilient lip portion for engaging and fastening to said side edge portions of said intermediate wall structure.

8. The apparatus of claim 1 including plastic foam thermal insulation material affixed to said intermediate wall structure for thermally insulating the container.

9. The apparatus of claim 1 wherein said end wall structures each include a lip portion extending along a path defined by and disposed adjacent said prongs to receive said end edge portion of said intermediate wall structure to facilitate end support of said intermediate wall structure.

10. The apparatus of claim 1 wherein said intermediate wall structure includes a pair of turned side wall portions and a central region therebetween, said central region being perforated to receive and support baskets therein.

11. The apparatus of claim 10 including, a transparent lid having downturned side wall portions and a central region therebetween, and means for affixing said downturned side wall portions to said intermediate wall structure.

12. The apparatus of claim 1 wherein each of said end wall structures comprises a plastic frame member, and insert means of generally planar geometrically configuration disposed within said frame.

13. The apparatus of claim 12 wherein said frame member is made of plastic foam.

14. In a plastic container:

a pair of plastic end wall structures;

intermediate plastic wall structures having a pair of spaced apart side edge portions and a pair of spaced apart end edge portions;

means for affixing said end wall structures to said intermediate wall structure; and said affixing means including clip means for clipping said end wall structures to said intermediate wall structure.

15. In a plastic container:

a pair of plastic end wall structures;

intermediate plastic wall structure having a pair of spaced apart side edge portions and a pair of spaced apart end edge portions;

means for affixing said end wall structures to said intermediate wall structure; and said intermediate wall structure including at least one bendable hinge line portion of thinner wall construction than that of adjacent regions of said intermediate wall structure to allow bending of said intermediate wall structure along said hinge line portion.

16. In a plastic container:

a pair of plastic end wall structures;

an intermediate plastic wall structure having a pair of spaced apart side edge portions and a pair of spaced apart end edge portions;

means for affixing said end wall structures to said intermediate wall structure; and each of said end wall structures including a pair of generally parallel narrow side edges spaced apart by a pair of generally parallel broad top and bottom side edges, said narrow side edges each including a central recessed region to facilitate ventilation to the side walls of the container when the containers are stacked in side-by-side relation.

17. In a plastic container:

a pair of plastic end wall structures;

an intermediate plastic wall structure having a pair of spaced apart side edge portions and a pair of spaced apart end edge portions;

means for affixing said end wall structures to said intermediate wall structure; and each of said end wall structures including a pair of generally parallel narrow side edges spaced apart by a pair of generally parallel broad top and bottom side edges, said broad side edges including upwardly directed tab portions at opposite ends thereof for mating with recessed regions in an adjacent container when the containers are stacked in vertical relation.

18. In a plastic container:

a pair of plastic end wall structures;

an intermediate plastic wall structure having a pair of spaced apart side edge portions and a pair of spaced apart end edge portions;

means for affixing said end wall structure to said intermediate wall structure; and each of said end wall structures including a pair of generally parallel narrow side edges spaced apart by a pair of generally parallel broad top and bottom side edges, said bottom side edge portions including recessed regions at opposite ends thereof for mating with tab portions on end wall structures of an adjacent container when the containers are stacked vertically.

* * * * *